United States Patent [19]

Taylor

[11] Patent Number: 4,965,897

[45] Date of Patent: Oct. 30, 1990

[54] ADJUSTABLE APPENDAGE FOR MATTRESS PROVIDING MEANS

[76] Inventor: Clarence R. Taylor, 28 Woodside Dr., Penfield, N.Y. 14526

[21] Appl. No.: 496,643

[22] Filed: Mar. 21, 1990

[51] Int. Cl.[5] ..... A47C 21/06

[52] U.S. Cl. ..... 5/446; 5/440

[58] Field of Search ..... 5/81 R, 90, 431, 440, 5/441, 446, 447; 128/69, 70, 845

[56] References Cited

U.S. PATENT DOCUMENTS

| | | | |
|---|---|---|---|
| 2,521,530 | 9/1950 | McCuffage | 5/440 X |
| 3,026,541 | 3/1962 | Murat | 5/81 R |
| 3,806,968 | 4/1974 | Robey | 5/446 |
| 3,974,827 | 8/1976 | Bodeen | 5/446 X |
| 4,005,498 | 2/1977 | Starr et al. | 5/81 R |
| 4,669,455 | 6/1987 | Bellati | 128/69 X |
| 4,791,682 | 12/1988 | Iwase | 5/447 |

FOREIGN PATENT DOCUMENTS

| | | | |
|---|---|---|---|
| 28375 | of 1911 | United Kingdom | 5/81 R |

*Primary Examiner*—Michael F. Trettel

[57] ABSTRACT

An adjustable appendage that can be located under any mattress for the purpose of providing back support in the pelvic bone area; and furthermore an appendage that can be inflatably adjusted for any degree of support necessary to provide optimum comfort.

4 Claims, 1 Drawing Sheet

ADJUSTABLE APPENDAGE FOR MATTRESS PROVIDING MEANS

BACKGROUND OF THE INVENTION

1. Field of the Invention

This invention relates generally to back problems that a great many people encounter despite any type of mattress they try. The mattresses just don't seem to be able to supply the kind of back support they need.

2. Description of the Prior Art

Outside of providing varying degrees of mattress firmness for people afflicted with a difficult back-related sleeping problem nothing seems to have been done. As a result many have to resort to padded boards which is fine for younger people but not for older ones. For those without recourse the "morning back-ache" syndrome is experienced which is only relieved gradually by moving about.

Over thirteen years of trial and error has resulted in the adjustable appendage device described herein. It appears to provide the relief needed no matter how the user sleeps; on his back, either side or stomach. It is installed under the mattress in the pelvic bone area, where the body weight concentrates, and inflated by air to provide optimum comfort; and at which point the air pressure is locked in.

SUMMARY OF THE INVENTION

In accordance with a preferred embodiment of the invention an adjustable appendage for a mattress is disclosed comprising a fairly rigid baseboard member to which is permanently fastened end blocks and spacers which house a flexible metal plate suitably reinforced and supported by an inflatable tube. The inflatable tube is connected by hose to a rubber bulb and valve assembly which provides means for not only varying the air pressure in the tube but also for locking in the air at that pressure. This whole assembly is enclosed in a suitable fabric cover for convenience of handling and also for appearance.

It is accordingly one of the objects of the present invention to provide an adjustable appendage for a mattress which will provide means for correcting any abnormal displacement in the mattress that occurs in the pelvic area where body weight concentrates. Correcting this displacement realigns the back bone to its' more normal position to prevent any undue pain and discomfort.

Another object of the invention is to provide a device for changing the contour of a mattress in such a way that no distortion, in the area of the pelvic bone, can take place to the backbone sufficient to cause pain and discomfort, and furthermore a device that is adaptable to any mattress, or to any mattress and box spring combination, without alteration to either.

Another object of the invention is to provide a device that is lightweight and easy to install under a mattress and one that can be readily adjusted for position and pressure.

Another object of the invention is to provide a device for correcting a sleeping problem caused by mattress induced backbone misalignment in the pelvic bone area that is adaptable for one and all. One size fits everyone.

The invention and its objects and advantages will become more apparent from the detailed description of the preferred embodiment presented below.

BRIEF DESCRIPTION OF THE DRAWINGS

In the detailed description of the preferred embodiments of the invention presented below, reference is made to the accompanying drawing, in which.

DESCRIPTION OF THE PREFERRED EMBODIMENTS

Figure 1:
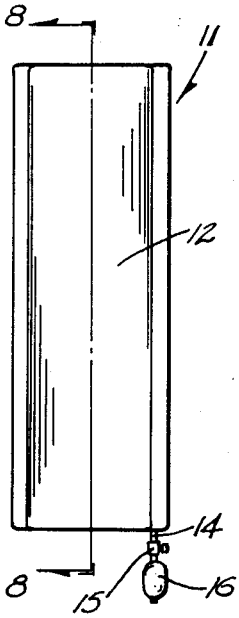
FIG. 1 is a plan view of a preferred embodiment of the adjustable appendage of this invention.
Figure 2:
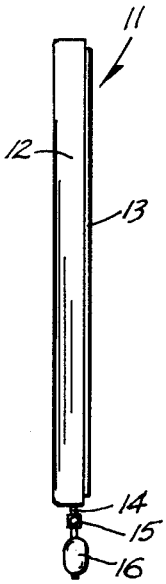
FIG. 2 is a side view of the adjustable appendage shown in FIG. 1 in an inflated condition.
Figure 3:
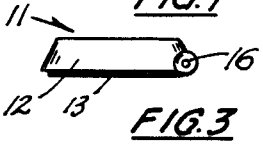
FIG. 3 is an end view of the adjustable appendage shown in FIG. 1.
Figure 7:
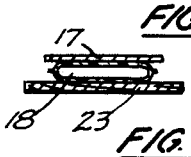
FIG. 7 is a section view taken on line 7—7 of FIG .5.

Referring to FIGS. 1,2 & 3 of the drawings, a preferred embodiment of the adjustable appendage 11 of this invention is disclosed. What is most apparent is the real or artificial leather fabric coverings 12 & 13 and the adjusting means consisting of air bulb 16, control and locking valve 15 and air tube 14. These adjusting means are also shown in FIGS. 4,5,6 & 10.

Figure 8:
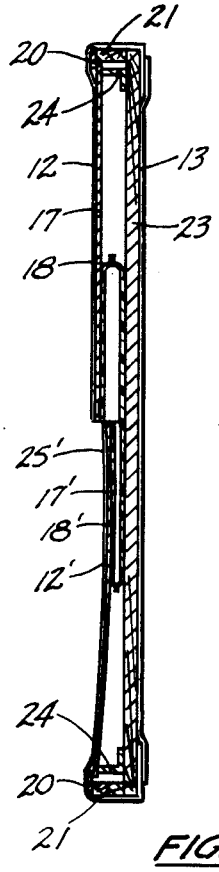
FIG. 8 is an enlarged section view taken on line 8—8 of FIG. 1 showing also inflated and deflated conditions.
Figure 9:
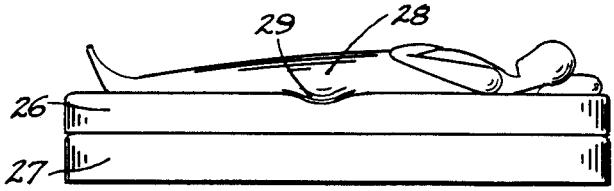
FIG. 9 is a side view of a sleeping form showing normal mattress deflection under the pelvic area.
Figure 10:
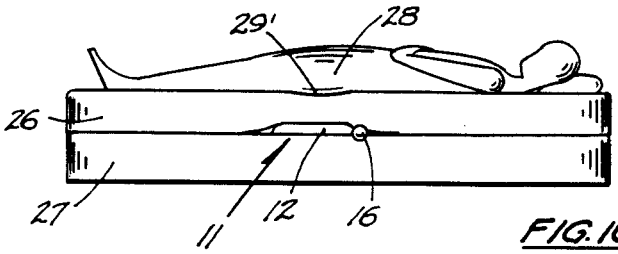
FIG. 10 is a side view of a sleeping form showing use of the adjustable appendage of this invention in correcting mattress deflection under the pelvic area.

As shown in FIGS. 5,6,7 & 8 the adjustable appendage of this invention consists, outside of the above mentioned fabric coverings 12 & 13 and adjusting means 14, 15 & 16, of a base or support board 23 to which is rigidly fastened end blocks 21 and spacer angle plates 24 best shown in FIG. 8. Also located on and fastened to board 23 is inflatable tube 18 which is also shown in FIG. 8 in inflated and deflated conditions. Resting on inflatable tube 18 and confined by end blocks 21 and plates 20, which fasten permanently to end blocks 21, is a flexible metal plate 17 with support flanges 22, best shown in FIGS. 5,6,7 & 8. As shown in FIG. 10 flexible metal plate 17, as part of adjustable appendage 11, with cover fabric 12, supports the mattress 26 at the pelvic bone area 29' of individual user 28. FIG. 9 shows normal mattress deflection 29 under the pelvic bone area, where body weight concentrates, without any corrective device. Box spring 27 is shown in FIGS. 9 & 10 as support for adjustable appendage 11.

Figure 4:
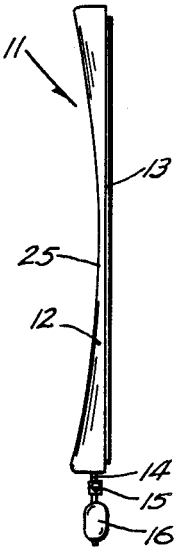
FIG. 4 is a side view of the adjustable appendage shown in FIG. 1 in a deflated condition.

FIGS. 2,4 & 8 show the adjustable appendage of this invention in both the inflated, or extended, and the deflated, or retracted, positions. This deflated or retracted position is best shown at 25 in FIG. 4 and at 25' of FIG. 8 which also shows comparisons between relative positions of covering fabric 12, flexible metal plate 17 and inflatable tube 18 wherein the deflated positions are shown as 12', 17' and 18'.

Figure 5:
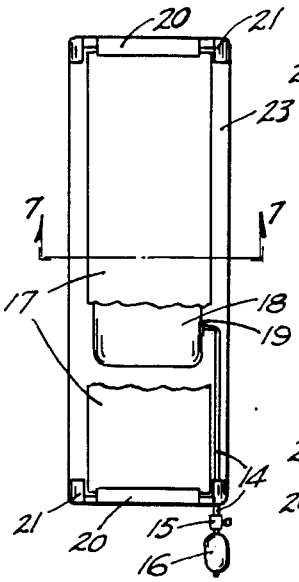
FIG. 5 is a plan view and partial section view of the adjustable appendage without the exterior covering.
Figure 6:
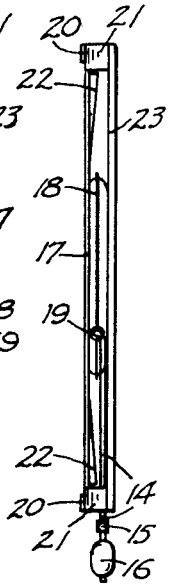
FIG. 6 is a side view of the adjustable appendage shown in FIG. 5.

FIGS. 5 & 6 show air tube connection 14 between inflatable tube 18 and adjusting and locking means 15 & 16, and seal 19 between air tube 14 and inflatable tube 18.

The invention has been described in detail with particular reference to a preferred embodiment thereof, but it will be understood that variations and modifications can be effected within the spirit and scope of the invention described hereinabove.

I claim:

1. An adjustable appendage for mattress for inserting into a crosswise position between a mattress and boxspring or other firm support means in the pelvic bone area comprising;

a rectangular base board or support member;

a containment and spacer assembly permanently affixed to each end of said base board or support member;

a flexible metal plate, with reinforcement angles, contained by and extended between said containment and spacer assemblies;

an inflatable rubber tube device fastened centrally to said base board and support member and on which rests said flexible metal plate;

a rubber bulb air pump, air lock-valve assembly and connecting hose sealed to said inflatable rubber tube device;

a fabric covering material for enclosing said assembled adjustasble appendage.

2. An adjustable appendage for mattress according to claim 1 wherein said fabric covering material can be artificial leather.

3. An adjustable appendage for mattress according to claim 1 which can be adjusted for overall thickness by the introduction of air from said rubber air pump and maintained in that condition by said air lock-valve assembly.

4. An adjustable appendage for mattress according to claim 1 wherein said inflatable tube device can be inflated by air by said rubber air pump sufficient to correct, in the pelvic bone area of said mattress, any abnormal depression caused by body weight and which depression could, unless corrected, cause misalignment of spine in the lumbar region with accompanying pain and discomfort.

* * * * *